US012514285B2

(12) United States Patent
Woldemariam

(10) Patent No.: US 12,514,285 B2
(45) Date of Patent: Jan. 6, 2026

(54) SMOKING APPARATUS AND METHOD OF SMOKING

(71) Applicant: Efrem Woldemariam, Seattle, WA (US)

(72) Inventor: Efrem Woldemariam, Seattle, WA (US)

( * ) Notice: Subject to any disclaimer, the term of this patent is extended or adjusted under 35 U.S.C. 154(b) by 380 days.

(21) Appl. No.: 18/156,680

(22) Filed: Jan. 19, 2023

(65) Prior Publication Data

US 2023/0329331 A1 Oct. 19, 2023

Related U.S. Application Data

(60) Provisional application No. 63/331,835, filed on Apr. 17, 2022.

(51) Int. Cl.

| | |
|---|---|
| ***A24F 1/24*** | (2006.01) |
| ***A24F 3/00*** | (2006.01) |
| ***A24F 9/16*** | (2006.01) |
| ***A24F 40/20*** | (2020.01) |
| ***A24F 40/485*** | (2020.01) |
| ***A24F 40/50*** | (2020.01) |
| *A24F 13/00* | (2006.01) |

(52) U.S. Cl.

CPC ..... *A24F 1/24* (2013.01); *A24F 3/00* (2013.01); *A24F 9/16* (2013.01); *A24F 40/20* (2020.01); *A24F 40/485* (2020.01); *A24F 40/50* (2020.01); *A24F 13/00* (2013.01)

(58) Field of Classification Search

CPC ..... A24F 1/00; A24F 1/02; A24F 1/24; A24F 3/00; A24F 13/00; A24F 13/06

See application file for complete search history.

(56) References Cited

U.S. PATENT DOCUMENTS

| | | | | |
|---|---|---|---|---|
| 3,804,100 | A * | 4/1974 | Fariello | A24F 1/14 131/193 |
| 4,066,088 | A | 1/1978 | Ensor | |
| 4,083,374 | A | 4/1978 | Jacobsen | |
| 4,200,114 | A | 4/1980 | Waite | |
| 4,369,798 | A | 1/1983 | Jackson | |
| 4,790,332 | A | 12/1988 | Wallace | |
| 4,807,646 | A | 2/1989 | Sahar | |

(Continued)

OTHER PUBLICATIONS

Yousuf H, Hofstra M, Tijssen J, Leenen B, Lindemans JW, Van Rossum A, Narula J, Hofstra L. Estimated Worldwide Mortality Attributed to Secondhand Tobacco Smoke Exposure, 1990-2016. JAMA Netw Open. Mar. 2, 2020;3(3):e201177. doi: 10.1001/jamanetworkopen.2020.1177. PMID: 32181828; PMCID: PMC7078760.

*Primary Examiner* — Eric Yaary

(74) *Attorney, Agent, or Firm* — Apex Juris, pllc; Tracy M Heims

(57) ABSTRACT

A smoking apparatus for smoking having a first chamber where the first chamber has at least one smoking material holder, at least one ignitor, at least one smoking conduit beginning outside of the smoking apparatus and extending into the first chamber of the smoking apparatus; a second chamber having a cavity encapsulating the first chamber; an exhalation conduit; at least one exhaust fan; an air purifier; at least one air filter; an external exhaust; and electronics and a power supply to power and control the at least one exhaust fan and the at least one ignitor.

20 Claims, 11 Drawing Sheets

(56) References Cited

U.S. PATENT DOCUMENTS

| | | | | |
|---|---|---|---|---|
| 5,388,595 | A * | 2/1995 | Shafer | A24F 13/00 131/206 |
| 5,529,078 | A | 6/1996 | Rehder et al. | |
| 2019/0307165 | A1 * | 10/2019 | Carney | A24F 13/06 |

* cited by examiner

SMOKING APPARATUS AND METHOD OF SMOKING

BACKGROUND OF THE INVENTION

Field of the Invention

This invention relates to a device used by smokers for reducing smoke pollution and, more specifically, to a device which allows a cigarette or other smoking materials to be lighted and smoked, and the smoke therefrom filtered and removed from the air exhausted from the device.

Background of the Invention

Health problems related to the inhalation by non-smokers of "passive" or "second hand" smoke, produced by smokers while they are lighted and smoking, has been well documented. In fact, according to the JAMA Network, "The World Health Organization estimates that the 1 billion individuals who smoke worldwide contribute to the 880,000 secondhand smoke (SHS)—related deaths among individuals who do not smoke each year." The present invention is designed and created to help mitigate this extremely important issue. Although it seems that this number is going down there is still a significant impact on non-smokers by smokers. The prior art is replete with devices that attempt to alleviate or eliminate second-hand smoke released into a surrounding atmosphere by smokers during smoking. One such device, disclosed in U.S. Pat. No. 4,807,646, utilizes a bladder to contain exhaled smoke and prevent such from escaping into the ambient atmosphere. While suitable for its intended purpose, the bladder is cumbersome and will build up in pressure making exhalation of cigarette smoke a difficult task. To drain the bladder of exhaled smoke, a manually controllable flap must be opened, resulting in unfiltered smoke escaping to the surrounding atmosphere. Furthermore, the device allows smoke to escape when the cigarette is first lighted.

Another device, disclosed in U.S. Pat. No. 4,790,332, filters exhaled smoke prior to releasing it to the atmosphere. While suitable for its intended purpose, the device has no means of creating the vacuum necessary to supply combustion air and pull the smoke from the lighted end through the filter. Furthermore, while using replaceable filters, the device offers no convenient way to maintain the inside of its body, which will eventually build up a tar residue from repeated use. Finally, the device does not prevent smoke from escaping when the cigarette is first lighted.

Other patents that disclose devices showing approaches to solving the above stated problem include U.S. Pat. Nos. 4,200,114, 4,066,088, 4,369,798, 5,529,078 and 4,083,374. It is abundantly clear that a need exists for a device for use by smokers which reduces pollution released into the ambient air by smoking, to remove smoke from the exhaled air, to easily output clean, or clean scented air, and to provide a pleasing look and feel to the user or an entertaining user experience. It is beneficial to have a device where a cigarette can be lit and smoked entirely within the device, so that no smoke, or only a minimal amount of the resulting smoke, passes out of the device without first being filtered. It is also desirable in such a device that the smoke from the burning end is actively drawn through a filtration system located entirely within the device, and then exhausted into the ambient air. This would also draw in the necessary combustion air. It would further be desirable if the device provided an inexpensive and conveniently replaceable cartridge within which tar and ash from repeated use could be contained and easily disposed. Another advantage would be provided if the cartridge contained the device's filtration system so that the filtration system could simultaneously be conveniently and inexpensively replaced. A final advantage would be to provide a means to use different types of essential oils into the apparatus whereby the oils are used to clean the smoke and then output a clean, scented air.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

These and other aspects of the invention will be apparent from and elucidated with reference to the embodiment(s) described hereinafter.

OBJECTS AND SUMMARY OF THE INVENTION

Against the foregoing background, a smoke house, or smoking apparatus and method of using the smoking apparatus is provided which offers convenient use to the smoker, is simple and inexpensive to maintain, that allows the cigarette or smoking material to be lighted so that the smoke generated, both during the lighting of the cigarette or smoking material and during smoking, does not pass to the outside atmosphere without first being filtered or, in the alternative, exhausted directly outside. These advantages are accomplished using a housing having a variety of openable and closeable housing portions. In a preferred embodiment of the present invention, the housing looks like a house or some other alternative design. This external design can be any of a variety of houses, living spaces, or any pleasing configuration.

The smoke house has a first chamber that defines a storage cavity within which a smoking apparatus is placed. This smoking apparatus provides a holding cavity for tobacco or other smoking materials and a heating element, or ignitor, where the heating element is used to ignite and burn the smoking materials. The first housing is encapsulated by a second housing. A fan is provided to move smoke through and out from the apparatus. A filter is provided to clean the smoke. The fan pulls the smoke from the chamber through the filter. From the chamber the smoke is pulled through an essential oils bath where thereafter the smoke is vented to the surrounding atmosphere.

The present invention further includes a mouthpiece assembly which is detachably mounted in sealing relationship to the smoke house. The invention further includes a second mouthpiece assembly for exhaust smoke that is also detachably mounted in a sealing relationship to the smoke house. The smoke house also has a loading chamber so that a cigarette, tobacco or other smoking materials may be loaded into the first chamber prior to being lighted by an ignitor.

The accompanying drawings, which are incorporated in and form a part of the specification illustrate preferred embodiments of the present invention, and together with the description, serve to explain the principles of the invention. In the drawings:

BRIEF DESCRIPTION OF THE DRAWINGS

The objects and features of the invention can be better understood with reference to the claims and drawings described below. The drawings are not necessarily drawn to scale, and the emphasis is instead generally being placed upon illustrating the principles of the invention. In the drawings, like reference characters generally refer to the same parts throughout the different views. Also, the drawings are not necessarily to scale, emphasis instead generally being placed upon illustrating the principles of the inventive subject matter.

For a further understanding of these and objects of the invention, reference will be made to the following detailed description of the invention which is to be read in connection with the accompanying drawings, wherein.

DETAILED DESCRIPTION OF THE EMBODIMENTS

The disclosed subject matter will become better understood through review of the following detailed description in conjunction with the figures. The detailed description and figures provide example embodiments of the invention described herein. Those skilled in the art will understand that the disclosed examples may be varied, modified, and altered without departing from the scope of the invention described herein.

Throughout the following detailed description, various examples of the smoking apparatus and embodiments thereof are disclosed. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature or example.

The invention will now be described in detail with reference to the attached drawings. As described above in the summary there is a need for a smoke house that efficiently and cleanly prevents smoke from entering a room. There is also a need for a smoking apparatus that provides an enjoyable, relaxing and entertaining way to smoke that also prevents smoke from entering the surrounding atmosphere.

The FIGS. Illustrate a preferred smoke house of the present invention. Ideally, the entire smoke house is designed to look like a traditional house of any culture. That is, it could be in the shape of an Alaskan Igloo, an Eritrean Hidmo, a Japanese Minka, or any other structure. The design can be large or more compact and can look like a traditional house, as just described. It should be noted that the design is not restricted to traditional homes but could be of any structural design. It is also noted that the design does not need to be a house but could be of any form as long as all the smoking apparatus elements are included. The invention will now be described in relation to the Figures.

Figure 1A:
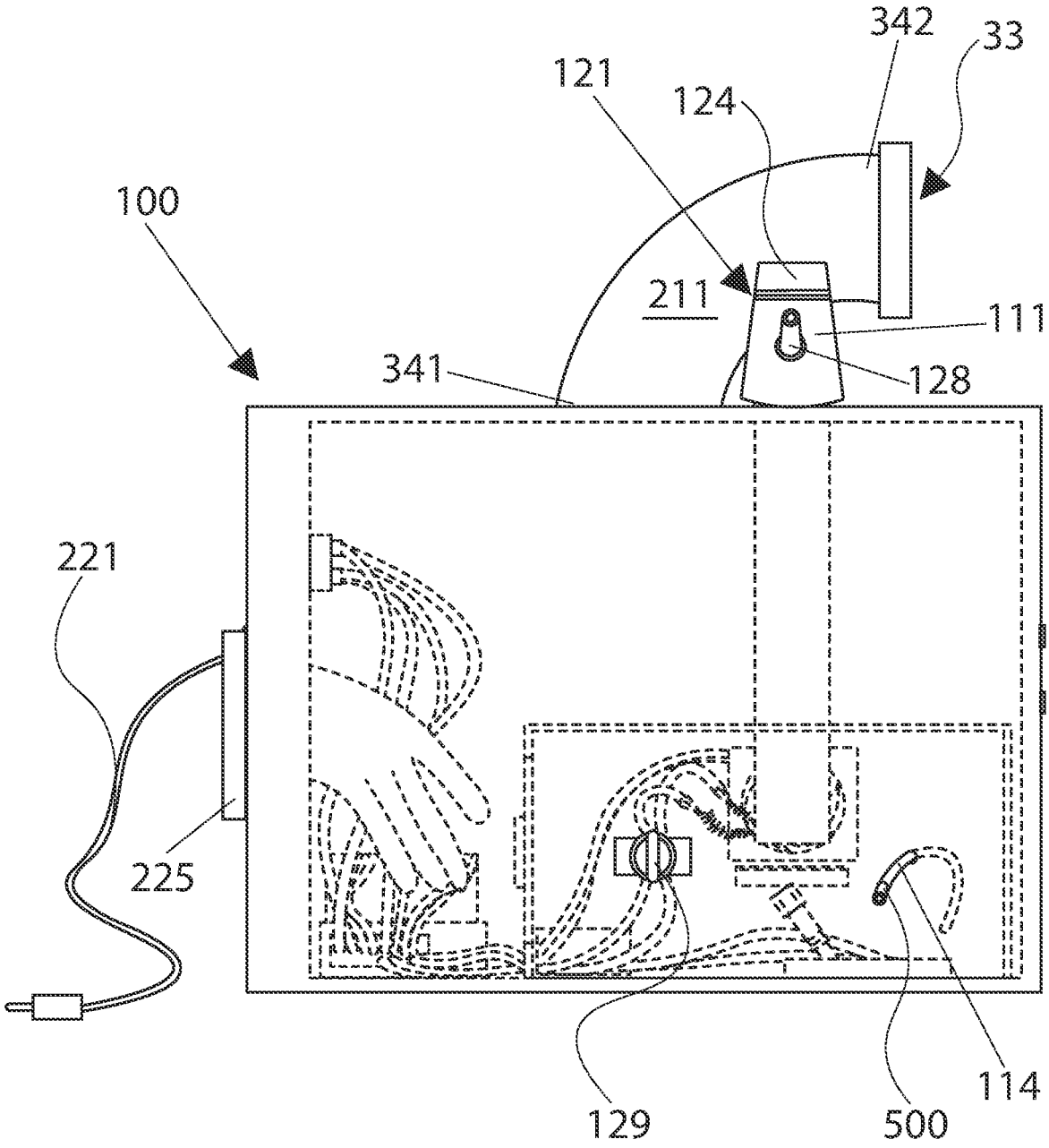
FIG. 1A is a view from the front of the smoke house.
Figure 1B:
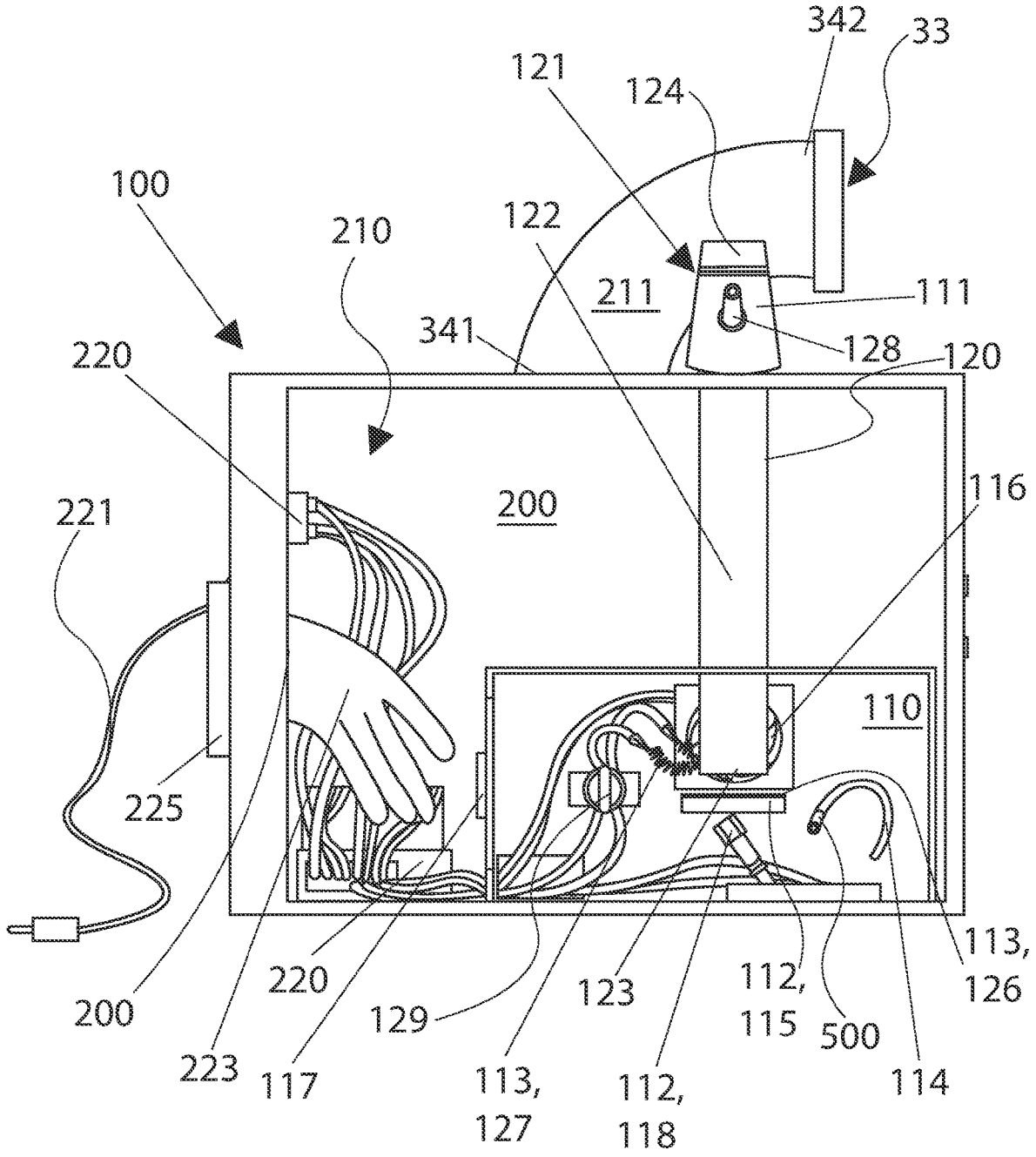
FIG. 1B is another view from the front of the smoke house showing the viewing window and the internal components of the apparatus.

FIG. 1A is a side view of a smoke house apparatus with a glass front. The components inside can be seen through the glass or plexiglass front. FIG. 1B is a similar side view of the smoke house apparatus 100 with the glass removed and all of the internal parts visible. In its most basic form, the invention includes a first chamber 110 having at least one loading apparatus 111 to load a smoking material, at least one holding space 112 for the smoking material, at least one ignitor 113, 127, and at least one smoking conduit 114 beginning outside of the smoking apparatus 100 and extending into the first chamber 110 of the smoking apparatus 100 for a user to use for inhaling smoke. Next, it has a second chamber 200, as shown in FIGS. 1B and 1*n* FIG. 7B, having a cavity 210 encapsulating the first chamber 110, an exhalation conduit 211 for a user to exhale smoke into the exhalation conduit 211 that then passes into the cavity 210, an exhaust fan 212, a liquid retaining receptacle 214, a rotatable wheel 215, such as a mill wheel, an air filter 218, an external exhaust tube 219, electronics 220 and a power supply 221 to power and control the exhaust fan 212 and the at least one ignitor 113. The device also has a power cord or power supply 221 that provides power to the apparatus to run all the electrical components included in the apparatus.

This first chamber 110 defines the smoking area of the smoking apparatus 100. Inside the first chamber in its simplest form is the ignitor 113 and the at least one holding space 112 for the smoking material. The ignitor 113 can be automatically activated, it can be manually activated or could even be remotely activated. The ignitor 113 in one embodiment is connected to electrical power that provides power to the ignitor so that the ignitor can heat up until it is hot enough to light tobacco or other smoking material. This power could be via an electrical outlet through a power cord, from a battery, a solar panel or panels, or any other apparatus that could provide power.

Figure 8:
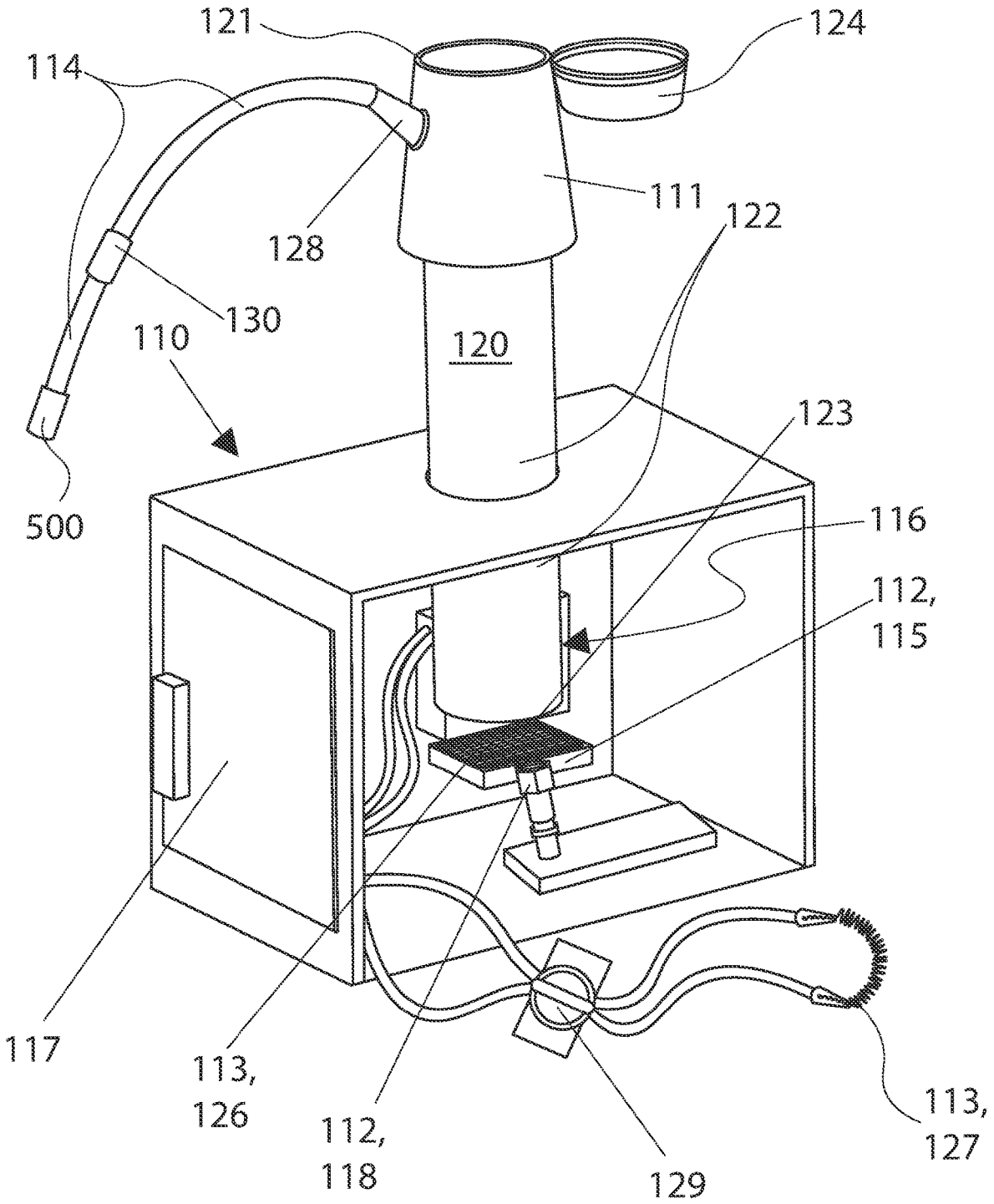
FIG. 8 is a perspective view looking into the smoke house apparatus from the front.

FIG. 1B and FIG. 8 show the details of the first method of loading and smoking the smoking materials. In this embodiment the smoking materials are loaded from the top, dropped down a tube and land on a mesh ignitor. More specifically, in this embodiment the invention has the elements just listed in addition to a loading tube 120 that has a first end 121, a middle section 122 and a second end 123. The first end extends outside of said second chamber and has an openable and closeable orifice 124 that can receive the smoking material. Ideally the loading tube 120 has the first end 121 extending upwardly from a top wall of the smoking apparatus 100 so that the smoking material can be deposited into the orifice 124 whereafter they drop down through the tube. The loading tube middle section 122 extends down through the top wall of the smoking apparatus until it reaches the first chamber 110. The loading tube second end 123 continues to extend down and into the first chamber 110. The insertion points at the first and second chambers are sealed so that no smoke or smoking material leaves the loading tube 120.

In one embodiment the at least one smoking conduit 114 is connected to the loading tube 120 at the first end 121 such that the smoking conduit 114 becomes part of the loading tube 120. That is, the smoking conduit's hollow center portion is joined with the hollow center portion of the loading tube 120 so that smoke rising up through the loading tube can be inhaled up through the loading tube and then through the smoking conduit. As seen in FIG. 8 and FIG. 1B the smoking conduit 114 is joined to the loading tube 120 at a smoking conduit connector 128. In the Figs. this connection forms a Y but it is understood that any other connection method could be used to connect the smoking conduit 114 to the smoking conduit connector 128 and then the smoking conduit connector 128 to the loading tube 120. This could include joining at a T, having the smoking conduit connector 128 and the loading tube 120 as single tube for both loading and smoking, or having the smoking conduit 114 extend from the end of the loading tube 120. The smoking conduit 114 could also be entirely separate from the loading tube. It could run alongside the loading tube or be inserted into the smoking chamber any other way possible. In this particular embodiment where the smoking conduit and the loading tube are the same, the user loads the smoking material through the loading tube 120 and uses the loading tube 120 in conjunction with the smoking conduit 114 to smoke the smoking material. Another option here is to have the smoking conduit 114 extend through a side of the first chamber 110 where a user could use the loading tube 120 to load the smoking material, seal it shut, and then smoke from the smoking conduit 114 that extends from the side wall of the smoking apparatus 100, as seen in FIGS. 1A and 1B.

Smoking material loaded onto metal mesh ignitor. As seen in FIG. 8, the loading tube middle 122 section passes down into the smoking apparatus 100 and into the first chamber 110 so that the smoking material can drop down through the loading tube 120 to the loading tube second end 123. This loading tube second end 123 terminates at or near the at least one ignitor 113 and in this embodiment the at least one ignitor is an electrically heated metal mesh member 126. This ignitor has an on/off switch 129 located on the outside of the smoking apparatus that is easily accessible to the user. This ignitor could also be automatically activated by the weight of the smoking material and then could also be automatically deactivated when the smoking material turns to ash and is removed by ash fan 116 from the mesh member 126. It could also have sensors of some sort on or about the mesh member 126 to indicate when the smoking material is present and these sensors could then turn the ignitor on and off, depending on the presence or absence of the smoking material.

This embodiment is generally used for smoking loose-leaf smoking materials. As shown in FIG. 8, the orifice 124 is opened, the loose-leaf smoking materials are dropped into the loading tube 120 through the orifice 124 and down to the loading tube second end 123 where they eventually land and rest on top of the electrically heated metal mesh ignitor member 126. This ignitor member 126 is made of a thin mesh metal that is connected to a power source. The user will turn the on/off switch 129 to the on position and electricity is passed through the thin metal where the resistance causes the metal to heat up to a point where the loose-leaf smoking material burns. When the smoking material begins to burn, in a first embodiment, the user will inhale the resultant smoke up and through the loading tube 120, then out through the smoking conduit connector 128, through the smoking conduit 114 and finally through the smoking tip 500 and to the user. Next to the metal mesh ignitor 126 there is the ash fan 116 and below the ignitor 126 is an ash collector 115. As the smoking material burns, ash is created. The ash is blown down into the ash collector 115 by the ash fan 116, thus keeping the metal mesh ignitor 126 clean and free of ash. This ash collector 115 is easily removeable from the smoking apparatus so as it fills it can be cleaned out by the user. It can be a slide tray or some other carrier that can easily be removed from the smoking apparatus. In any situation, when the ash collector is in place it forms a tight seal with the body of the smoking apparatus so as to prevent smoke from leaving the smoking apparatus and entering the atmosphere.

Smoking material loaded into the rolled smoking member holder. In another embodiment, shown in FIGS. 1B, 2 and 8 there is shown an alternative way to load the smoking material into smoking apparatus 100. This embodiment is specifically designed to load a rolled smoking member but could also be used to load loose-leaf material onto the metal mesh ignitor 126. The rolled smoking member application is described first.

Figure 2:
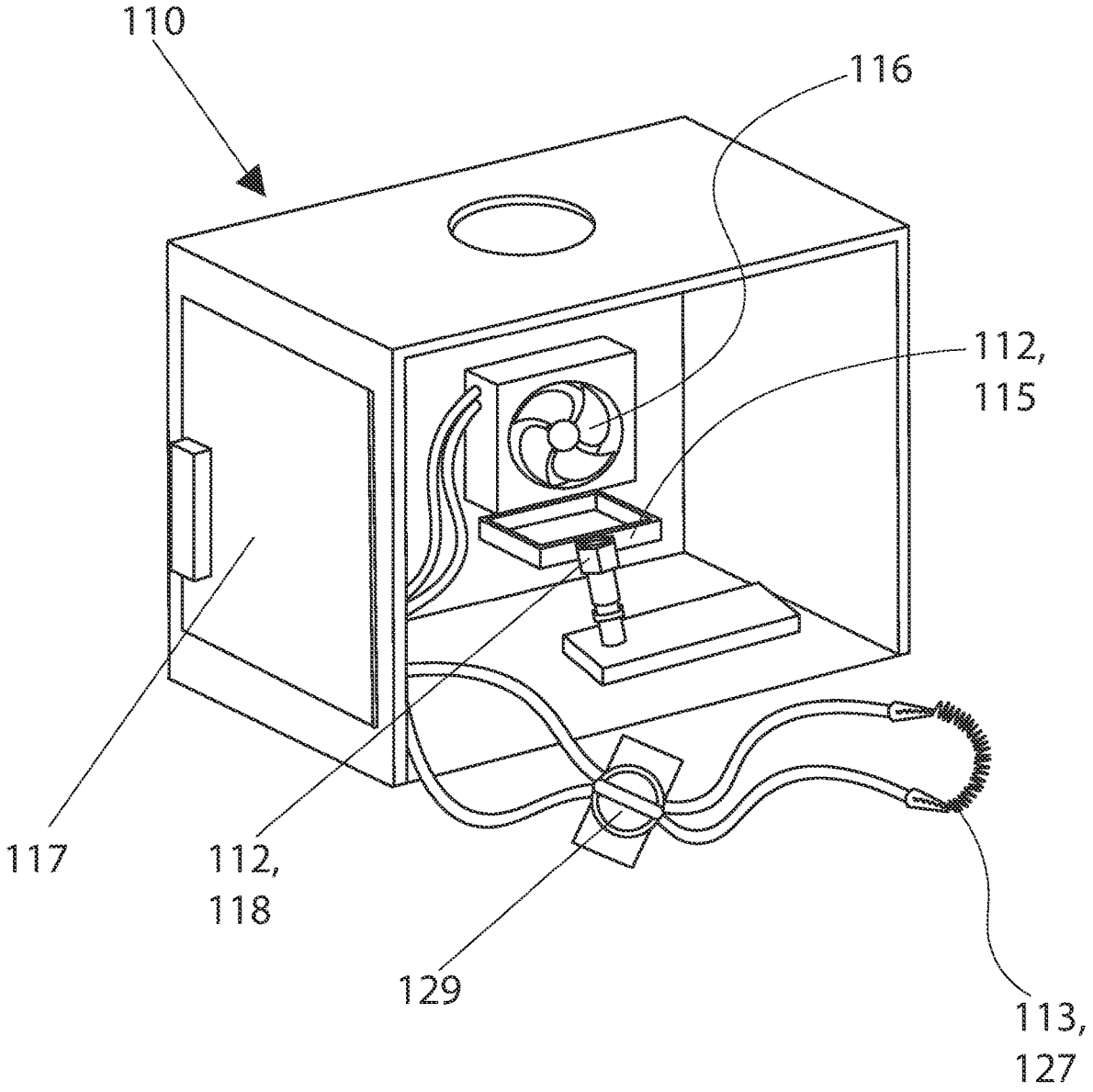
FIG. 2 is an elevated perspective view of the first chamber of the smoke house.
Figure 3:
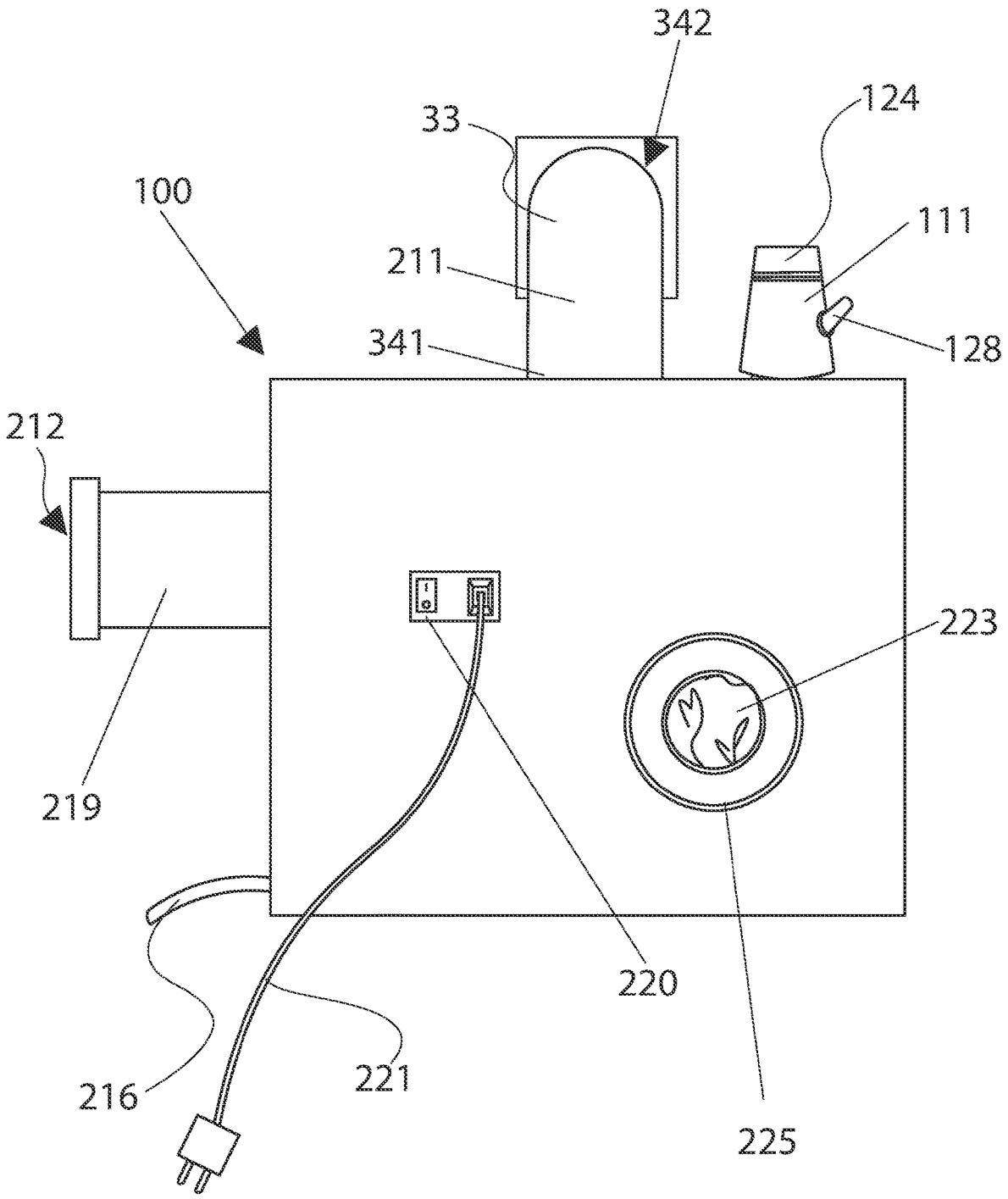
FIG. 3 is a side view showing a first side where a glove is used to load the inside smoking apparatus.

In this embodiment the at least one ignitor 113 is an electronically heated coil member 127, shown in FIGS. 1B and 2, similar to the mesh ignitor 126 described above, but configured to effectively light a rolled smoking member, such as a cigarette. This ignitor is a coil ignitor 127 that generally has an end formed by a coil metal member where electricity is run through the coil so that the coil metal member heats to a point that is hot enough to light the smoking material. This coil ignitor 127 has an on/off switch 129 located on the outside of the smoking apparatus that is easily accessible to the user. The loading apparatus is different in this embodiment. Here, the at least one loading apparatus to load the smoking material is a rolled smoking member holder 118. This member is generally a cylindrical tube where the rolled smoking member is inserted into the tube. However, it could be a clip or any other type of holding member that will provide a way to hold a rolled smoking member in place. For use in this embodiment, the smoking material is rolled in a smoking paper to form the rolled smoking member. To further facilitate efficient and effective use of this iteration the smoking apparatus can have a rolling apparatus, such as for a cigarette, affixed to the body. This roller can be manually operated or it can be mechanical and powered.

FIG. 1B further shows a sealable ingress and egress 225 located at one exterior side of the second chamber. This provides access to the inner, first chamber 110 where there is a second sealable ingress and egress 117 that provides access to the first chamber 110. The at least one ignitor is the electronically heated member 127 as described above, the at least one loading apparatus 111 to load the smoking material is a rolled smoking member holder 118, the smoking material is rolled in a smoking paper to form the rolled smoking member where the rolled smoking member is inserted through the first sealable ingress and egress 225 into the second chamber and then through the second ingress and egress door 117 to the first chamber and is inserted into the rolled smoking member holder 118, where the electronically heated member 127 can light the rolled smoking member. The ingress/egress 117 can be anything that allows a user access to and from the first chamber 110. It could be a door, a flap, a rubber member through which a user can insert a hand, or any other type of closure that allows ingress and egress to the first chamber 110. The ignitor also can be any type of ignitor. In the preferred embodiment it is an electrically heated member, but it could be a plastic sparkwheel, a piezo spark, a butane torch, an electric coil, an electric arc or any other type of lighter designed to light a cigarette.

Figure 9:
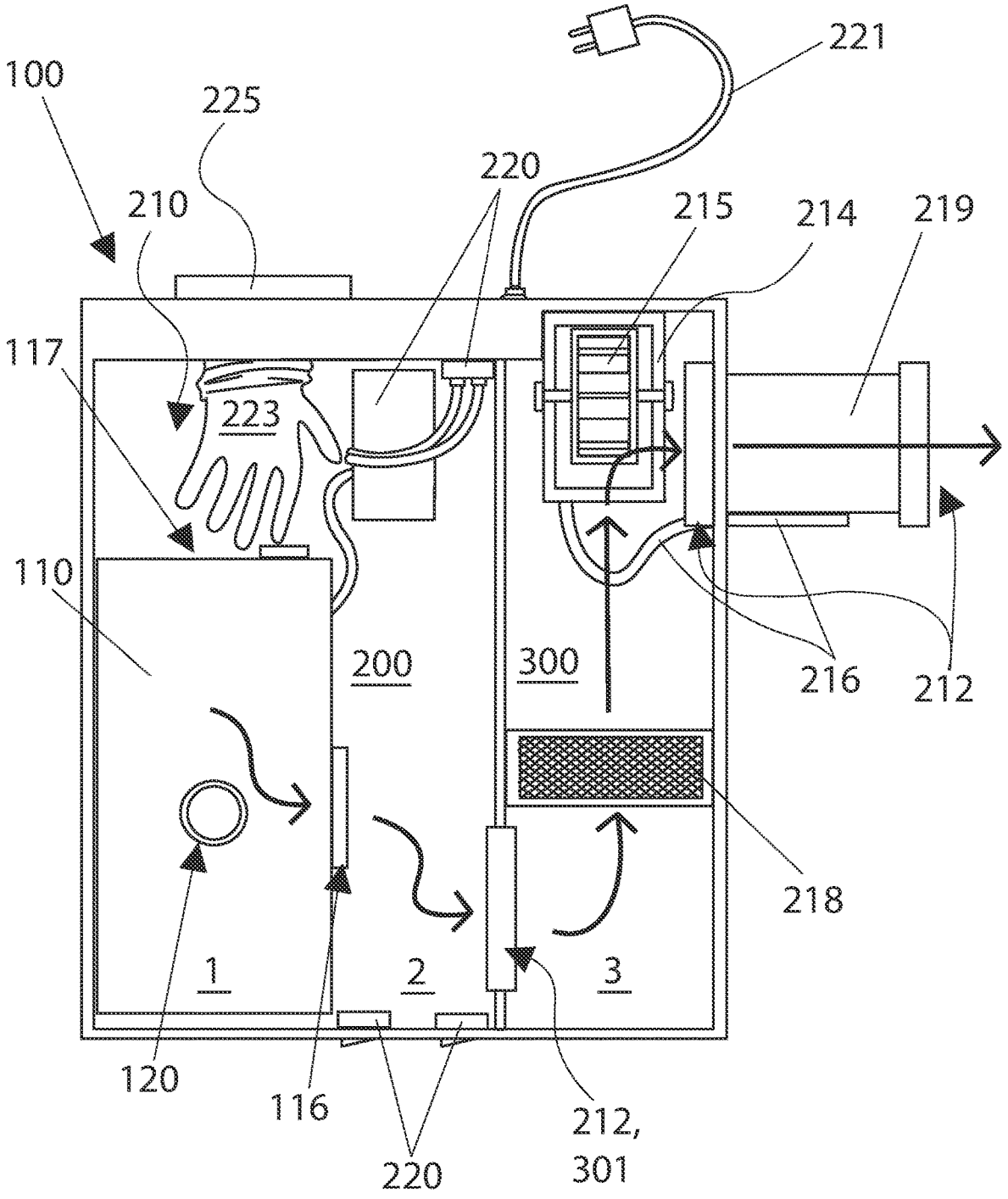
FIG. 9 is a top side view looking down into the smoke house apparatus with the top removed, showing the first, second and a third chamber.

To operate this configuration the rolled smoking member is inserted through the sealable ingress and egress 117 to the first chamber 110 and is inserted into the rolled smoking member holder 118 where the electronically heated member 127 can light the rolled smoking member. The smoking member can be loaded either through the sealable ingress/egress 117 or the rolled smoking member holder 118 can be physically removed from the smoking apparatus 100 so that the smoking member can be loaded outside the smoking apparatus 100. After loading, the smoking member holder 118 is then reinserted into the smoking apparatus 100 and into the first chamber 110. If the smoking member holder 118 is loaded through the door it is also possible to have a fire-resistant glove member 223. The glove 223 provides protection for the user and is ideally heat and fireproof to avoid burns or injury to the user. As shown in FIGS. 7B and 9 the glove 223 forms part of an entry passage to both the second chamber 200 and the first chamber 110. The glove member 223 is part of a larger removeable entry member that is the sealable ingress and egress member 225. This larger entry member can be screwed onto the smoking apparatus or it can be part of a door member that is easily opened and closed. When removed or opened this entry member provides greater access to the inside of the smoking apparatus and can be used to clean or repair any portion of the internal portions of the smoking apparatus 100. When this larger removeable entry member is secured to the smoking apparatus the user can place a hand into the glove member 223 in order to gain access to both the first and second chambers, as seen in FIG. 9. To use properly, the user takes and holds the unlit smoking member with the glove member 223, then inserts the unlit smoking member through the second chamber, into the first chamber 110 and then inserts the unlit smoking member into the smoking member holder 118.

The smoking apparatus 100 is simple to use. In operation, the user loads the smoking material into the smoking material holding space 112. As described above, this holding space can be loaded either through the loading tube 120 such that the smoking material is dropped down into the loading tube 120 and then rests on top of the heated metal mesh member 126 or it can be loaded through the dual ingress/egress 117, 225 loading apparatus where the rolled smoking member is held in the rolled smoking member holder 118 and is lit using the ignitor that is the electrically heated member 127. In either case, the smoking material is loaded into the smoking material holding space 112. After loading the smoking material it is ignited using either of the ignitors just explained.

The smoking apparatus 100 next has at least one smoking conduit 114. This smoking conduit 114 provides the means for the user to inhale the smoke from the ignited smoking material. In one embodiment, shown in FIG. 1B, this smoking conduit 114 is a tube that is inserted into the burn chamber, or first chamber 110, and then goes through a first wall of the smoking apparatus and extends outside the smoking apparatus so that it is accessible to the user. This smoking conduit ideally has a smoking tip 500 that can easily be attached and detached from the smoking conduit. This smoking tip 500 can be any of a wide variety of styles, designs, all interchangeable.

In another embodiment the smoking conduit 114 works in conjunction with the loading apparatus 111. As seen in FIG. 8, the loading tube first end 121 extends from outside the top of the smoking apparatus 100, then the loading tube middle section 122 extends down through second chamber 200 and the loading tube second end 123 terminates in the burn chamber, or first chamber 110. In this embodiment the loading tube 120 acts as both a loading tube and as a smoking conduit 114. As can be seen in the FIG. 8, the smoking conduit tube 114 is connected to the smoking conduit connecting member 128 at the loading tube first end 121 just below the openable and closeable orifice 124 and outside the smoking apparatus 100. In one configuration the tube extends upwardly and outwardly from the loading tube 120 in a Y type orientation. However, it could be a T or any other configuration so long as it is connected to the loading tube 120. The smoking conduit 114 can be made of plastic, rubber, silicone or other material, either flexible or solid. A flexible material is preferable as it allows the user to move to different positions and it provides an easier way to smoke. Alternatively, the smoking conduit 114 could be a hard material, such as metal, pvc, hard plastic, or any other hard material than can be formed into a cylinder, tube or any passageway for the smoke. In the preferred embodiment it is made of a flexible material and it connects to the loading tube 120 so that the user can load the device through the loading tube and then smoke through the same tube. This configuration eliminates parts, is easier to manufacture and is easier to use.

In operation, the user opens the openable and closeable orifice 124 at the loading tube first end 121, loads the smoking material into the tube whereafter it drops down on top of the ignitor that is the electrically heated metal mesh member 126. The user then closes the closeable orifice 124, turns on the ignitor 126 with a switch located on the outside of the smoking apparatus, whereafter the smoking material begins to burn. The user then inhales the resultant smoke up through the loading tube 120, smoking conduit connector 128, and the smoking conduit 114. This smoking conduit also has a replaceable smoking tip 500. This smoking tip 500 can any of a wide variety of smoking tips and can be personalized to each user. The tip is easily attached and removed from the smoking conduit 114 so that each user can use his or her own smoking tip 500. Design, style, configuration and look of these tips is limitless. Additionally, the smoking conduit 114 can have a one-way check valve 130 inserted in the tube so that when the user inhales the smoke and air is allowed to move in the direction of the user but when the user ceases to inhale the check valve reverses so that additional smoke is prevented from escaping from the smoking conduit 114. This is another way to prevent the smoke from contaminating the clean air in the smoking environment.

Figure 4:
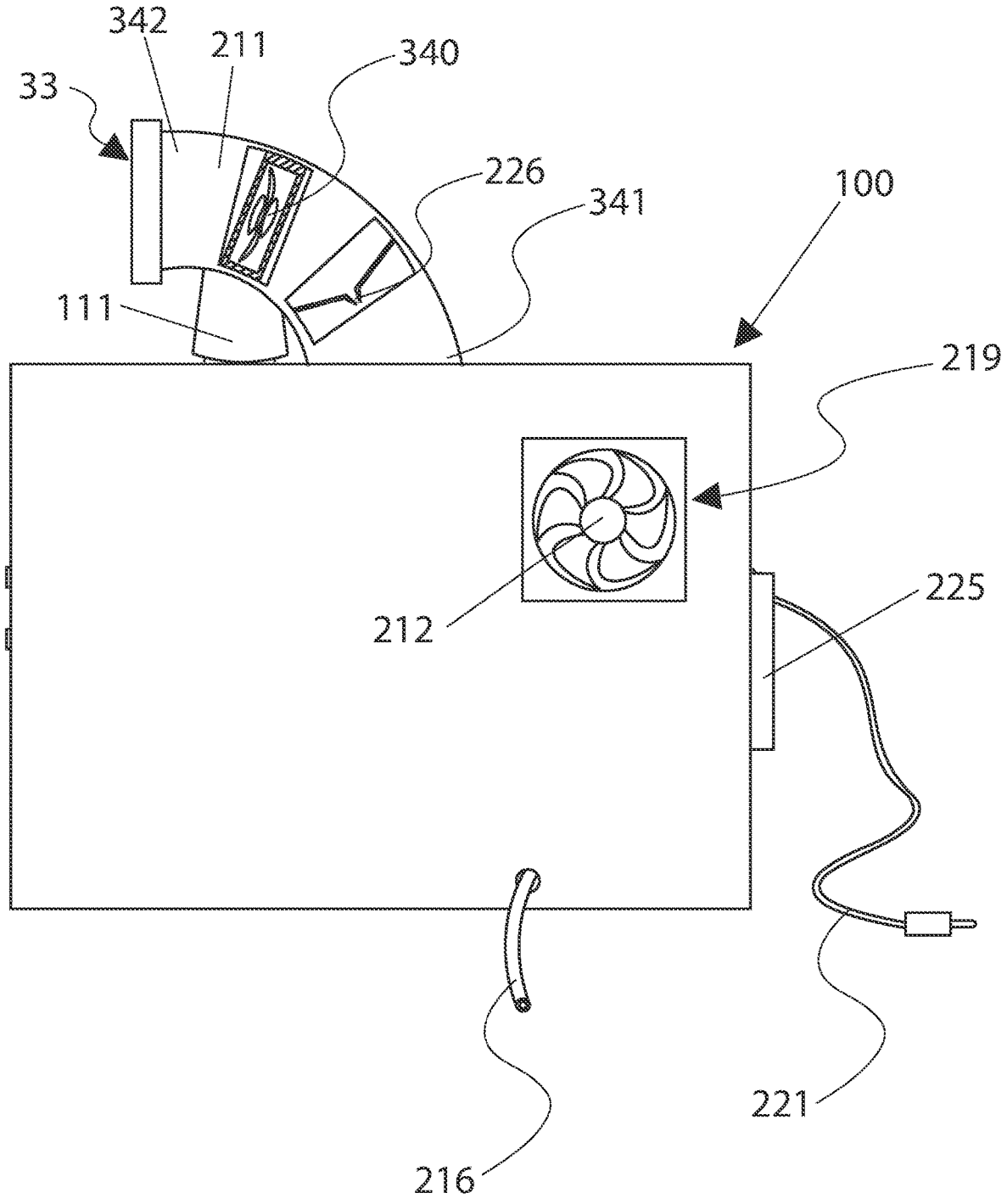
FIG. 4 is a second side view of the smoke house apparatus.
Figure 5:
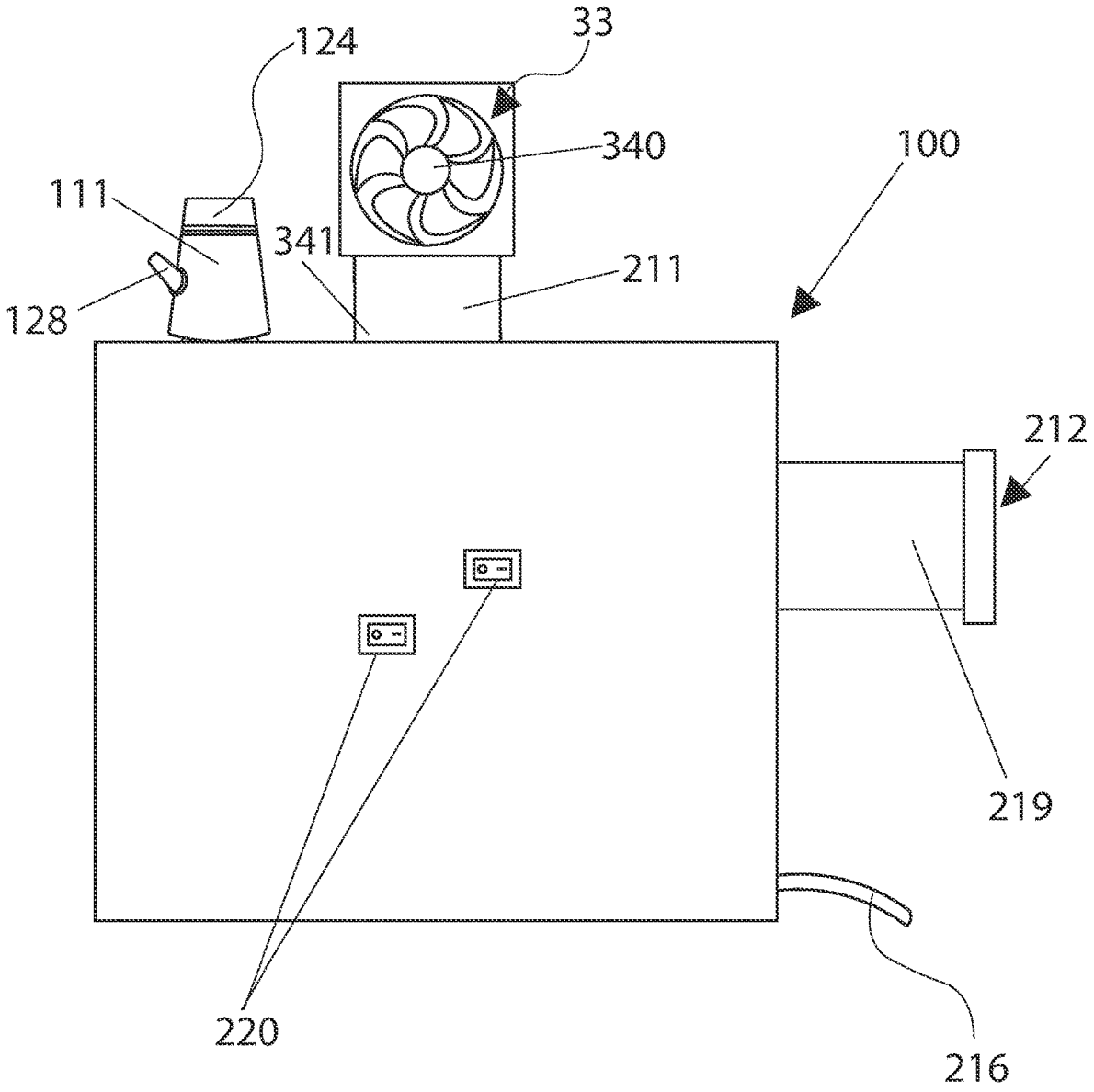
FIG. 5 is a rear side view of the smoke house apparatus.
Figure 6:
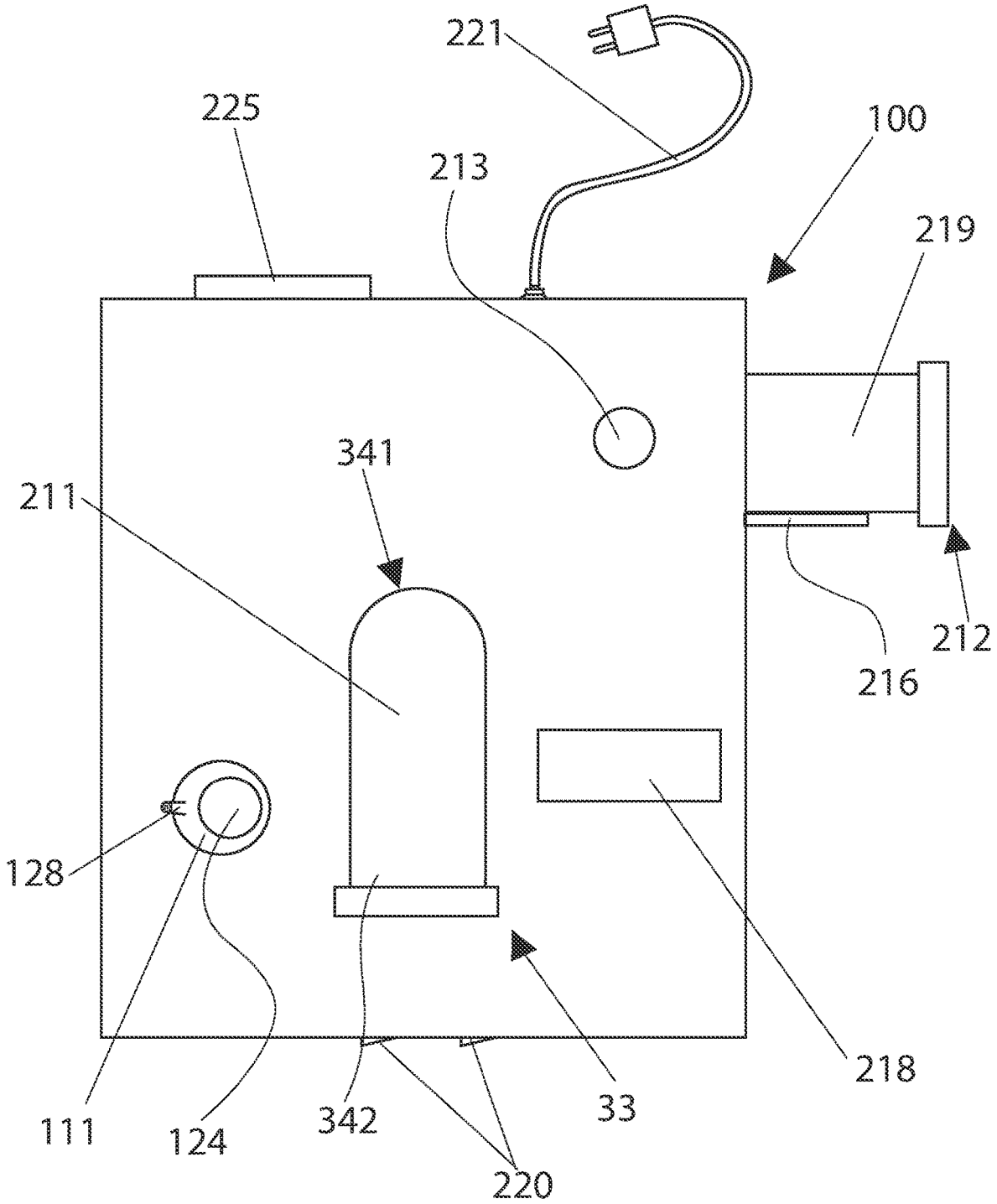
FIG. 6 is a top side view of the smoke house apparatus.

Next, the smoking apparatus has a variety of devices designed to clean, purify and even add scent to the air that is exhausted from the apparatus. To properly clean the air exhaled from the user the present invention uses a variety of devices. When the user is ready to exhale the user exhales into the exhalation tube 33 that is connected to the exhalation conduit 211, shown in FIG. 1B. The exhalation conduit 211 can also have a second one-way check valve 226, as shown in FIG. 4, so that when the user exhales the smoke into the exhalation conduit 211 it is allowed to only go into the purification chamber and will not escape into the room. This exhalation conduit 211 has a distal end 342 that faces the user and a proximal end 341 that openly communicates with the second chamber 200 of the smoking apparatus 100 such that when the user exhales the smoke goes through the exhalation conduit 211 and passes into the second chamber 200. This exhalation conduit 211 is a hollow tube (flexible or rigid). In a preferred embodiment, this exhalation conduit 211 has an intake fan 340, located somewhere along the exhalation conduit 211 or even at the top wall of the smoking apparatus. It could be located at the distal end 342, the proximal end 341, or anywhere along the conduit 211. This fan 340 draws the smoke into the smoking apparatus 100 and ideally the fan 340 is powerful enough so that the user does not actually have to place his or her mouth on the tube, but rather the fan 340 will create a vacuum that is strong enough to pull the smoke out of the air, into the smoking apparatus 100 and then into the cavity 210.

FIG. 9 shows a smoke path after exhalation. In one embodiment, after the smoke enters the cavity 210 it is drawn out using the exhaust fan 212. FIGS. 9A, 9B and 9C show three embodiments. In one embodiment there are only two chambers, as shown in FIG. 9A, but in a preferred embodiment there is a third chamber, 300. In this three chambered embodiment the user breathes in smoke from the first chamber, or burn chamber 110. The smoke is then exhaled into the exhalation conduit 211. It passes through the conduit and enters the second chamber 200. Adjacent to the second chamber 200 is the third chamber, as can be seen in FIG. 9. This chamber has an opening 301 communicated between the second chamber 200 and the third chamber 300. This opening can simply be an unimpeded opening or it can contain a first air filter. In one embodiment the second chamber contains the air cleaning system, but ideally the third chamber contains the air cleaning system.

The system also can include an air purification system, as shown in FIG. 9. In this system the apparatus has the exhaust fan 212, the liquid filling tube 213, the liquid retaining receptacle 214, scented liquid, or scented oil 217, the rotatable wheel 215, the liquid retaining receptacle clean out 216, the first exhaust air filter 218, the external exhaust tube 219 and electronics 220, a power supply to power 221 and control the exhaust fan 212, the ignitor 113, and a variety of control switches to power on and off the fans, ignitors and millwheel 215. In one embodiment the millwheel is turned by an electric motor 222. It is envisioned that each could have its own control switch or, in the alternative, there could be a main switch that turns everything on and off at once and from one single location. This air purification system is ideally located within the third chamber 300. After the user smokes he or she exhales into the exhalation conduit 211. The exhausted smoke-air then is drawn into the second chamber 200 whereafter it is drawn out and into the third chamber 300 through the opening 301 between the second and third chambers. The smoke-air is drawn into the third chamber 300 via the exhaust fan 212. This fan can be located at or near the end of an exhaust transfer tube 310 or it can be anywhere between the second and third chambers so that it pulls the smoke from the second chamber into the third chamber. There can also be an exhaust filter 218 located somewhere along the smoke exit path or at the exhaust fan 212 to clean the air a first time. As noted above, alternatively there could be another filter located between the second and third chambers, as seen in FIG. 7B. The smoke-air is drawn into the exhaust transfer pathway and past this first exhaust air filter 218. This can be a charcoal filter, a HEPA filter, or any other type of air purifying filter. All filters in the smoking apparatus are easily changeable and cleanable. The smoke-air is then pulled through the exhaust transfer pathway where, if a second filter is provided, it passes through a secondary air filter 224. This air filter is not required but can be added to the exhaust transfer pathway to remove more smoke particulate. After passing through the secondary filter 224 the smoke-air reaches the liquid cleaning chamber.

Figure 7A:
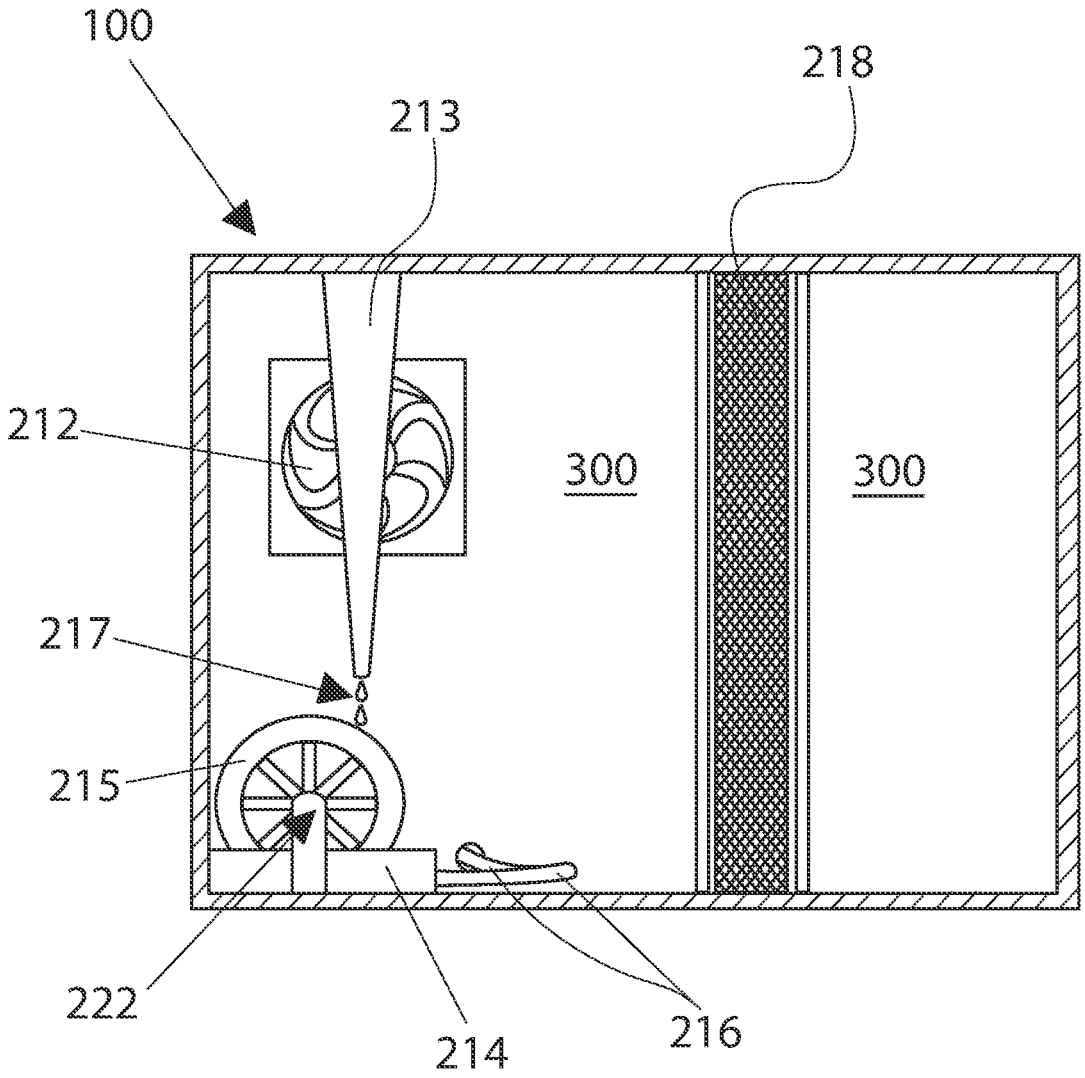
FIG. 7A is a side view of the third chamber of the smoke house apparatus showing the air purification system.
Figure 7B:
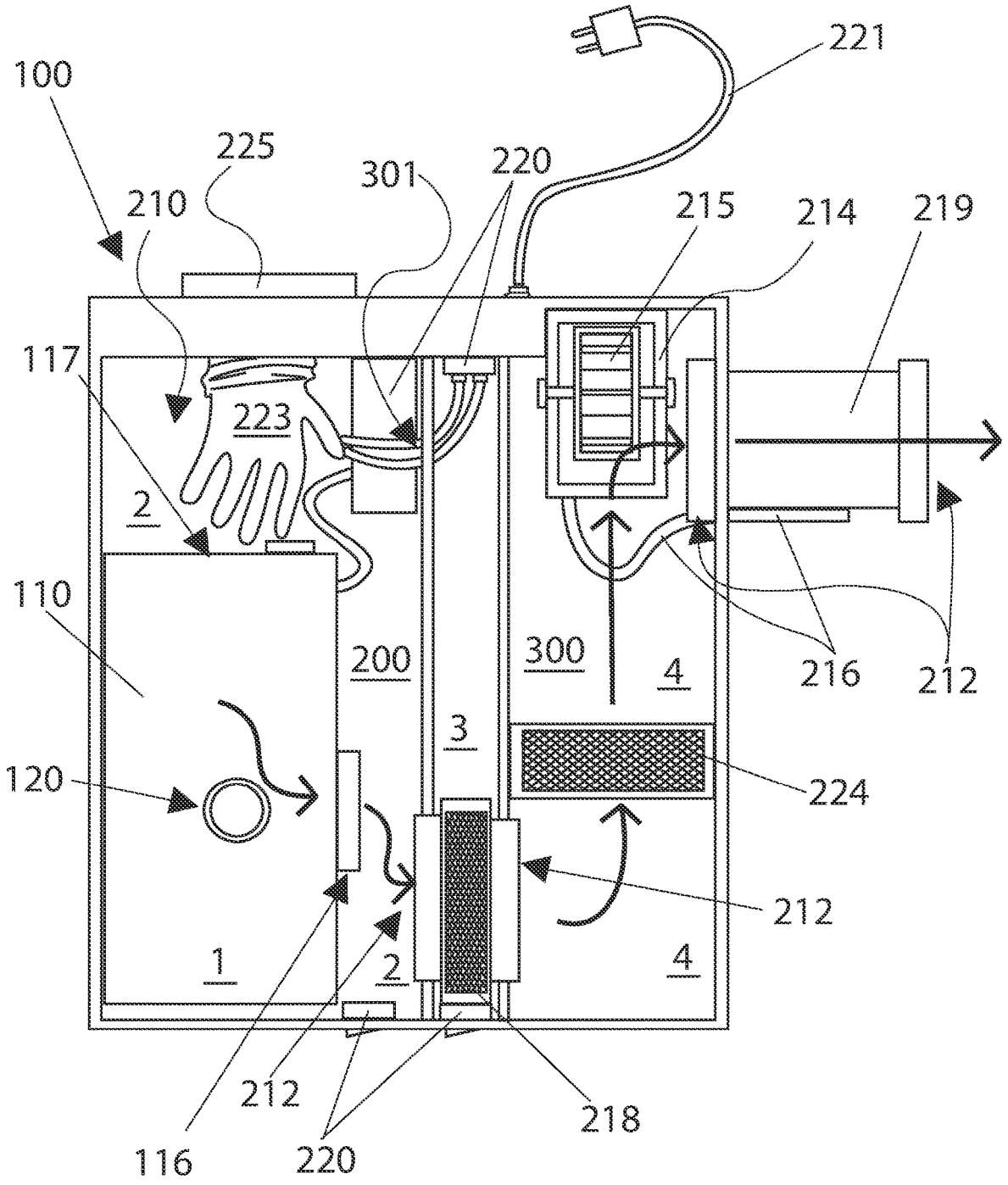
FIG. 7B is a top side view looking down into the smoke house apparatus with the top removed, showing the first, second, third and a fourth chamber.

FIGS. 7A, 7B and 9 show the liquid purification system of the liquid cleaning chamber. This liquid cleaning chamber is not required but does more fully clean the air and can scent the air prior to exiting the apparatus and is preferably included. Ideally this liquid cleaning chamber contains a liquid filling tube 213, the liquid retaining receptacle 214, the rotatable wheel, or mill wheel 215, the scented liquid or oil 217, and a liquid retaining receptacle clean out 216 to easily remove old oil or liquids so that they can be replaced with clean oil or liquid. In operation the user loads the scented liquid or oil 217 through the liquid filing tube 213 into the liquid retaining receptacle 214. Generally, the liquid filling tube has a fill hole located at the top of the smoking apparatus 100 where the user can pour the oil into the fill hole and down into the liquid retaining receptacle 214. The liquid flows through the tube that extends down from the fill hole and into the third chamber 300 whereafter it terminates at the liquid retaining receptacle 214. To remove the liquid there is the liquid retaining receptacle clean out 216, that is typically another tube that extends from a bottom of the liquid retaining receptacle 214 and then out from the smoking apparatus 100. This clean out 216 has an open/close mechanism so that the oil remains in the retaining receptacle until the user is ready to drain the oil. The user can open the mechanism to drain the oil out into another holding apparatus or into a disposal tank or garbage. The rotatable wheel 215 is typically a mill wheel that sits in the retaining receptacle 214, and is powered by the electric motor 222, so that when the wheel rotates about an axis the lower portion of the wheel passes through the liquid in the retaining receptacle 214, thus disrupting the oil and bringing some of the oil to the top of the wheel to thereafter drain down and over the wheel, so that the oil is continually moved and aerated, keeping it fresh. The wheel can have paddles, or scoops or any other design so that the oil is moved up to the top of the wheel and then runs down the wheel, again, keeping the oil aerated and moving. Alternatively, the system could simply have an oil bath without the wheel or even have no oil at all, but rather some other scented material, all being easily exchanged and replaced, thus providing an additional way to purify and clean the smoke.

The exhausted smoke-air is pulled up into the third chamber or into the exhaust transfer tube 310 by the exhaust fan 212, through the first air filter 218, through the third chamber or transfer tube 310, through the second filter 224, whereafter it enters the liquid cleaning chamber. Here, the smoke-air passes through the area holding the scented oil 217 and the rotating mill wheel 215. As it passes through this area the previous smoke-air is now smoke-free air, free of pollutants from the smoke because of the one or two filters, and, as it exits the liquid cleaning chamber, it is also now scented due to passing through the scented oil 217. As noted, there need not actually be scented oil. There could be no oil and no scented cleaning section or there could be another means of cleaning and scenting the air. It could be scented oils, scented filters, spray scents, wood chips, or any other type of product that could scent the air as it passes through.

After moving through the liquid cleaning chamber the air exits the smoking apparatus either directly into the external air, or through the external exhaust tube 219. This tube ejects the air either out into the surrounding atmosphere or, in the alternative, the tube is run out through a window so that the air is ejected to the outside environment. This external exhaust tube 219 can be a tube alone, or it can have a final exhaust air filter 330. In addition, there can be yet another fan, an exhaust air filter fan 343 that is either alone in the external exhaust tube 219 or that is attached either before or after the final exhaust air filter 330. This filter can be placed within the third chamber or it can be placed inside the external exhaust tube 219. In any case, this final filter 330 and exhaust air filter fan 343 are a final air cleanser and air mover prior to the air exiting the smoking apparatus 100. This external exhaust tube 219 can be in any shape or size. It could be in the shape of a chimney or anything else that adds to the overall look, feel and design of the smoking apparatus.

In an alternative design, instead of a wheel there is a passageway where the oil or scented liquid is pumped to the top of the passageway. After it reaches the top of the passageway the oils either run down through a filter or they just drip down into the retaining receptacle at the bottom. The air passes through either the filter or the oil drip and is purified and scented as it passes through. This eliminates the requirement of the moving wheel and yet provides a way to continually aerate the oil or scented liquid. This filter, as with all the other filters, is easily removeable from the apparatus to be either changed or cleaned. Alternatively, this filter is placed either in front of or behind the mill wheel and the mill wheel is configured so that it can deposit the oil to the top of the filter. Again, this keeps the filter moist and continuously refreshed with clean oil.

The primary function of the invention is to clean, purify and scent the air prior to ejecting the air into the atmosphere outside the smoking apparatus. A secondary function of the invention is to provide an enjoyable smoking experience for the user. This can be accomplished through a number of additional elements. A first add-on is a grinder. Users use the grinder to prepare their smoking materials. This grinder can be affixed to the smoking apparatus at some location and can be either manually controlled or it can be electronically powered. The same power supply that powers the fans, ignitors and electric motor for the wheel on the smoking apparatus can likewise power the grinder. Also, there can be a rolling apparatus attached at some location on the apparatus. The rolling apparatus is to assist the user in preparing rolled smoking materials where the smoking materials are placed inside the rolling paper. One or both of these add-ons can be affixed to the smoking apparatus.

In order to make the smoking experience more enjoyable the smoking apparatus can be configured in a variety of forms and shapes. As described above, the entire smoke house can be designed to look like a traditional house. It can be from any culture. That is, it could be in the shape of an Alaskan igloo, an Eritrean Hidmo, a Japanese minka, or any other structure. The design can be large or more compact and can look like a traditional house, as just described. It should be noted that the design is not restricted to traditional homes but could be of any structural design. It is also noted that the design does not need to be a house but could be of any form as long as all the elements described are included.

The smoking apparatus can also be of a much smaller configuration. In one embodiment it can be a large apparatus that provides all of the above elements, but it could be a much smaller apparatus having fewer elements but still providing the same results. It could be as small as a handheld device where the fans are smaller, the oil wheel could be self-contained, or the apparatus could use a removeable scented oil filter rather than the wheel mechanism. This handheld apparatus is battery powered and is extremely portable. It is much more compact and simplified, having as few as one fan near the exhaust port that draws the air from the smoking chamber, into the exhaust chamber, through the scented filter and out through the exhaust tube.

In another embodiment on a top of the smoking chamber is a see-through member or window that can be made from glass, plexiglass, plastic or any other clear material. This window can be clear or colored and allows the user to see inside of the smoking apparatus to assist in loading the storage chamber and allows the user to view the smoke inside the chamber. Alternatively, a large portion or the entire house can be made from a clear material so that the entire insides are visible from outside. There can also be a variety of lights inside the chamber that illuminate the inside and provide a pleasing affect when the smoke moves around inside the chamber. In addition to the lights the box can have one or more speakers to provide music to the user while smoking in order to enhance the smoking experience. The speakers could be connected to a music source located on or within the smoking apparatus or, in the alternative, they could be connected to an external music player via cable, Bluetooth, or whatever other system is available.

Although the invention has been described with reference to the preferred embodiments illustrated in the attached drawing figures it is noted that equivalents may be employed and substitutions made herein without departing from the scope of the invention as recited in the claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The invention claimed is:

1. A smoking apparatus, comprising:
a first chamber comprising:
at least one smoking material holder;
at least one ignitor;
at least one smoking conduit beginning outside of said smoking apparatus and extending into said first chamber of said smoking apparatus;
a second chamber comprising:
a cavity encapsulating said first chamber;
an exhalation conduit having an intake fan;
at least one exhaust fan;
an air purifier;
at least one air filter;
an external exhaust; and
electronics and a power supply to power and control said at least one exhaust fan and said at least one ignitor.

2. The smoking apparatus of claim 1 further comprising:
at least one smoking material loading apparatus where said at least one loading apparatus further comprises:
a loading tube that has a first end, a middle section and a second end;
said first end extends outside of said first chamber and said second chamber and has an openable and closeable orifice that can receive smoking material;
one end of said at least one smoking conduit is connected through a side of said loading tube first end;
said loading tube middle section passes down into said smoking apparatus and into said first chamber and said smoking material can drop down through said loading tube to said second end;
said second end holds said at least one ignitor; and
said at least one ignitor is an electrically heated member.

3. The smoking apparatus of claim 2 further comprising:
an ash collector; and
a fan; where
said fan blows ash away from said electrically heated member and into said ash collector.

4. The smoking apparatus of claim 1 further comprising:
a sealable ingress and egress that provides access to said first chamber;
said at least one ignitor is an electronically heated member;
at least one smoking material loading apparatus to load said smoking material is a rolled smoking member holder;
said smoking material is a rolled smoking member;
said rolled smoking member is inserted through said sealable ingress and egress to said first chamber and is inserted into said rolled smoking member holder; where
said electronically heated member can light said rolled smoking member.

5. The smoking apparatus of claim 4 where said sealable ingress and egress that provides access to said first chamber is:
an open and closeable member on a wall of said first chamber; and
an access through a wall of said second chamber; where said access is a fire-resistant glove member; and where said user can place a hand into said glove, can reach into said second chamber and then into said first chamber.

6. The smoking apparatus of claim 1 where said air purifier further comprises:
a liquid retaining receptacle;
a scented liquid; where
said scented liquid is deposited into said retaining receptacle via a liquid filling device;
a rotatable wheel; and
a liquid retaining receptacle clean out; where
said rotatable wheel turns and passes through said liquid retaining receptacle and said scented liquid.

7. The smoking apparatus of claim 6 where said rotatable wheel is turned by an electric motor to aerate said scented liquid.

8. The smoking apparatus of claim 1 further comprising:
a third chamber located adjacent to said second chamber where said third chamber comprises:
an exhaust transfer;
said exhaust fan;
said at least one air filter;
a liquid retaining receptacle;
a rotatable wheel;
an opening communicated between said second chamber and said third chamber; where
said exhaust fan moves air from said second chamber;
into said third chamber;
through said opening;
through said at least one air filter;
past said rotatable wheel; and
out through said external exhaust.

9. The smoking apparatus of claim 8 further comprising:
a liquid filling device;
a liquid retaining receptacle clean out; and
a scented liquid; where
said liquid retaining receptacle is filled with said scented liquid through said liquid filling device and where said rotatable wheel turns so that said rotatable wheel passes through said liquid retaining receptacle and said scented liquid.

10. The smoking apparatus of claim 9 further comprising:
at least two air filters; and
at least two exhaust fans.

11. The smoking apparatus of claim 10 where said rotatable wheel is turned by an electric motor.

12. The smoking apparatus of claim 11 where said intake fan draws exhaled smoke into said second chamber.

13. A method of smoking using a smoking apparatus that provides a space to load a smoking material, that provides a way to smoke said smoking material and a way to purify exhausted smoke before expelling said exhausted smoke into an atmosphere, comprising the steps of:
a smoker loading a smoking material into a holding space within a first chamber of said smoking apparatus;
igniting said smoking material;
smoking said smoking material within said holding space;
said smoker inhaling smoke from said smoking material through a smoking conduit where said conduit begins inside said first chamber of said smoking apparatus and extends out through a wall of said first chamber;
exhaling said smoke by said smoker into an exhalation conduit;
pulling said smoke into said exhalation conduit and into a second chamber via an intake fan located within the exhalation conduit;
having at least one exhaust fan for moving said exhaled smoke; and
moving said exhaled smoke from said exhalation conduit, through at least one first filter, through an air purifier and emitting purified air out from said smoking apparatus.

14. The method of smoking of claim 13 further comprising the steps of:
using a liquid as said air purifier;
using a liquid filling device and filling a retaining receptacle with a scented liquid;
placing a rotatable wheel in said retaining receptacle and said scented liquid;
rotating said rotatable wheel and aerating said scented liquid;
moving said exhaled smoke through said liquid air purifier; and
emitting said liquid purified air out from said smoking apparatus.

15. The method of smoking of claim 14 further comprising the steps of:
loading said smoking material through a loading tube that has a first end, a middle section and a second end;
said first end extending outside of said second chamber having an openable and closeable orifice;
opening said orifice;
loading said smoking material into said first end;
dropping said smoking material through said first end, said middle section and to said second end;
receiving and holding said smoking material at said second end holding space;
connecting said at least one smoking conduit to said loading tube first end;
having at least one ignitor at said loading tube second end;
electrically heating said at least one ignitor; and
lighting said smoking material with said electrically heated member.

16. The method of smoking of claim 15 further comprising the steps of:
having the electrically heated member be a metal mesh member;
having an ash collector below said electrically heated member;
having a fan at said ash collector;
heating said smoking material using said metal mesh member;
smoking said smoking material;
using said fan and blowing ash off of said metal mesh member and into said ash collector.

17. The method of smoking of claim 13 further comprising the steps of:
having a sealable member providing access to said first chamber;
having a smoker using a hand, opening said sealable member and loading said smoking material through said sealable member and into said holding space within said first chamber where said smoking material is a rolled smoking member and said holding space is rolled smoking member holder;
removing said hand via said sealable member; and
closing and sealing said sealable member.

18. The method of smoking of claim 17 further comprising the steps of:
using a liquid as said air purifier;
using a liquid filling device and filling a retaining receptacle with a scented liquid;
placing a rotatable wheel in said retaining receptacle and in said scented liquid;
rotating said rotatable wheel and aerating said scented liquid;
moving said exhaled smoke through said liquid air purifier; and
emitting said liquid purified air out from said smoking apparatus.

19. The method of smoking of claim 18 further comprising the steps of:
using at least one exhaust fan for moving said air through said smoking apparatus;
placing a first exhaust fan at said exhaust conduit and drawing exhaled smoke into said smoking apparatus;
placing a second exhaust fan within said smoking apparatus for assisting in moving said exhaled smoke through said at least one first filter, through said air purifier and emitting purified air out from said smoking apparatus.

20. The method of smoking of claim 13 further comprising the steps of:
igniting and smoking said smoking material in said first chamber;
exhaling said smoke from said smoking material into said second chamber; and
having a third chamber where said third chamber is for purifying and cleaning smoke from exhaled air before emitting said purified air from said third chamber.

* * * * *